US008130065B2

(12) United States Patent
Wei

(10) Patent No.: US 8,130,065 B2
(45) Date of Patent: Mar. 6, 2012

(54) ELECTROMAGNETIC COIL DEVICE

(75) Inventor: Xianrang Wei, Zhejiang Province (CN)

(73) Assignee: Zhejiang Sanhua Co., Ltd., Xinchang County, Zhejiang Province (CN)

( * ) Notice: Subject to any disclaimer, the term of this patent is extended or adjusted under 35 U.S.C. 154(b) by 82 days.

(21) Appl. No.: 12/817,669

(22) Filed: Jun. 17, 2010

(65) Prior Publication Data

US 2010/0328004 A1 Dec. 30, 2010

(30) Foreign Application Priority Data

Jun. 25, 2009 (CN) ..... 2009 1 0149507

(51) Int. Cl.
*H01F 27/28* (2006.01)
*H01F 27/29* (2006.01)
*H01F 27/02* (2006.01)

(52) U.S. Cl. ..... 336/96; 336/192; 336/90; 336/229

(58) Field of Classification Search ..... 336/90, 336/96, 229, 192

See application file for complete search history.

(56) References Cited

U.S. PATENT DOCUMENTS

| | | | | |
|---|---|---|---|---|
| 4,459,575 | A * | 7/1984 | Geissler et al. | 336/96 |
| 4,543,554 | A * | 9/1985 | Muellenheim et al. | 336/83 |
| 5,226,220 | A * | 7/1993 | Gevas et al. | 29/605 |
| 6,798,328 | B2 * | 9/2004 | Uchiyama | 336/208 |
| 7,772,780 | B2 * | 8/2010 | Pokharna et al. | 315/56 |
| 7,782,162 | B2 * | 8/2010 | Nishida | 335/201 |
| 2004/0164832 | A1 * | 8/2004 | Skinner et al. | 336/90 |
| 2009/0045020 | A1 * | 2/2009 | Richeson | 188/161 |
| 2009/0134962 | A1 * | 5/2009 | Nishida | 335/207 |
| 2010/0328003 | A1 * | 12/2010 | Shibuya et al. | 336/90 |

* cited by examiner

*Primary Examiner* — Anh Mai

(74) *Attorney, Agent, or Firm* — Wolf, Greenfield & Sacks, P.C.

(57) ABSTRACT

The present invention discloses an electromagnetic coil device including a coil body having a connection terminal portion projecting from a circumferential surface of the coil body, a buckle having a positioning flat plate portion and an inserting flat plate portion fixedly connected to the positioning flat plate portion. The inserting flat plate portion is pottedly connected to the connection terminal portion with potting material. The electromagnetic coil device can, on the one hand, reduce the manufacturing cost and improve the reliability of the connection between the coil body and the buckle, and on the other hand, prevent the coil body from being damaged by welding and thus improve the life thereof.

10 Claims, 5 Drawing Sheets

ELECTROMAGNETIC COIL DEVICE

CROSS-REFERENCES TO RELATED APPLICATIONS

This application claims the benefit of priority to Chinese Application No. 200910149507.2 filed on Jun. 25, 2009.

FIELD OF THE INVENTION

The present invention relates to mechanoelectronic field, in particular to an electromagnetic coil device.

BACKGROUND OF THE INVENTION

The electromagnetic coil device may be applied to many fields, for example, may be used as a coil of an electronic expansion valve of a refrigeration system, or as a stator portion of a step motor. In particular, a typical application for the electromagnetic coil device is serving as the coil of the electronic expansion valve of the refrigeration system.

The electronic expansion valve of the refrigeration system generally includes an electromagnetic coil device and a valve body device connected with the electromagnetic coil device. The electromagnetic coil device includes a buckle, and the valve body device includes a fixing frame. The buckle is connected to the fixing frame, so as to achieve the connection between the valve body device and the electromagnetic coil device.

In operation, the electronic expansion valve drives a spool of the valve body device to move through the magnet field generated by energizing the electromagnetic coil device, so as to control the opening action of a valve port.

Referring to FIG. 1, a structural schematic view of a typical electromagnetic coil device in the prior art is shown.

The electromagnetic coil device in the prior art includes a buckle 11. The buckle 11 includes a first horizontal portion 111, a second horizontal portion 112 and a vertical portion 113 connecting the first horizontal portion 111 and the second horizontal portion 112. The electromagnetic coil device further includes a coil body 12 to which the first horizontal portion 111 is fixedly connected by a screw 13.

As can be seen from the above description, the first horizontal portion 111 of the buckle 11 is fixedly connected to the coil body 12 by the screw 13, such a fixed connection with screw is prone to loosen and thus may decrease the reliability of the connection between the coil body 12 and the buckle 11. Therefore, the operating stability of the electromagnetic coil device will be deteriorated and the cost is relatively higher.

In addition, there is another type of electromagnetic coil device in the prior art. In such electromagnetic coil device, the buckle is connected to the coil body by welding instead of the above screw connection. The buckle is made of metal material, such as a stainless steel sheet. A stator case of the coil body is made of magnetic-conductive material, such as a galvanized carbon steel plate. Therefore, the welding between the buckle and the stator case is a dissimilar metal welding, which usually needs to be carried out by a resistance welding.

Since a surface of the stator case has a galvanized coating, requirements for the welding process of the resistance welding are rigorous and the life span of welding electrodes are short. Further, since the buckle is welded to the stator case, the stator case can not be encapsulated with encapsulation material and thus have to be exposed to the atmosphere. When the stator case and the buckle are welded together, the stator case usually is subject to electrochemical corrosion, because they are made of different materials and have different electrode potential differences.

SUMMARY OF THE INVENTION

The technical problem to be solved by the present invention is to provide an electromagnetic coil device, which may, on the one hand, reduce the manufacturing cost and improve the reliability of the connection between the coil body and the buckle, and on the other hand, prevent the coil body from being damaged by welding and thus improve the life span thereof.

To solve the above described technical problem, the present invention provides an electromagnetic coil device including a coil body having a connection terminal portion projecting from a circumferential surface of the coil body, a buckle having a positioning flat plate portion and an inserting flat plate portion fixedly connected to the positioning flat plate portion, wherein the inserting flat plate portion is pottedly connected to the connection terminal portion with potting material.

Preferably, the connection terminal portion further includes a positioning groove, within which the inserting flat plate portion is pottedly connected with the potting material.

Preferably, the electromagnetic coil device further includes a terminal cover surrounding the connection terminal portion, wherein a potting chamber is formed between the terminal cover and the connection terminal portion and the potting chamber is communicated with the positioning groove via a communicating passage.

Preferably, the communicating passage is a communicating hole.

Preferably, the communicating passage is a communicating slot.

Preferably, the inserting flat plate portion further includes at least one positioning hole passing therethrough and the positioning hole is covered by the potting material.

Preferably, a positioning bending portion is provided at an end of the inserting flat plate portion and is covered by the potting material.

Preferably, the buckle further includes an arc-shaped connecting portion, through which the positioning flat plate portion is fixedly connected to the inserting flat plate portion.

Preferably, the positioning flat plate portion further includes a positioning projecting portion projected toward the coil body.

Preferably, the connection terminal portion is formed by way of injection molding.

Compared with the prior art, the electromagnetic coil device according to the present invention includes a coil body having a connection terminal portion projecting from a circumferential surface of the coil body, a buckle having a positioning flat plate portion and an inserting flat plate portion fixedly connected to the positioning flat plate portion, wherein the inserting flat plate portion is pottedly connected to the connection terminal portion with potting material. The potting material may be resin material, which is originally fluid-like, then gradually solidified after being placed for a period of time. Therefore, the fixed connection between the inserting flat plate portion and the connection terminal portion is achieved.

Compared with the screw connection, the fixed connection between the buckle and the coil body with potting material significantly improves the reliability of the connection therebetween. Furthermore, this kind of fixed connection may reduce the use of screw and thus reduce the manufacturing cost.

Compared with welding, the fixed connection between the buckle and the coil body with potting material may prevent a stator case from electrochemical corrosion caused by dissimilar metal welding between the buckle and the stator case of the coil body. Therefore, the life span of the electromagnetic coil is prolonged.

As can be known from the above description, the electromagnetic coil device according to the present invention can, on the one hand, reduce the manufacturing cost and improve the reliability of the connection between the coil body and the buckle, and on the other hand, prevent the coil body from being damaged by welding and thus improve the life thereof.

DETAILED DESCRIPTION OF THE INVENTION

The spirit of the present invention is to provide an electromagnetic coil device, which can, on the one hand, reduce the manufacturing cost and improve the reliability of the connection between the coil body and the buckle, and on the other hand, prevent the coil body from being damaged by welding and thus improve the life span thereof.

For better understanding the technical solutions of the present invention by persons skilled in the art, the present invention will be explained in detail below in conjunction with drawings and specific embodiments.

Figure 1:
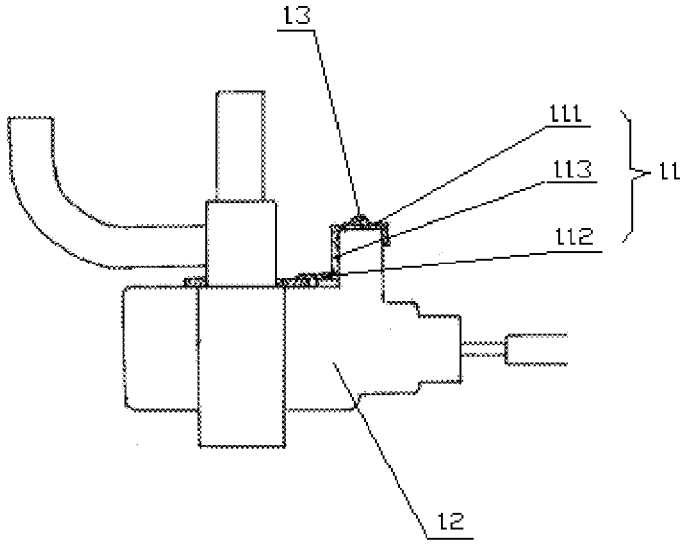
FIG. 1 is a structural schematic view of a typical electromagnetic coil device in the prior art.
Figure 2:
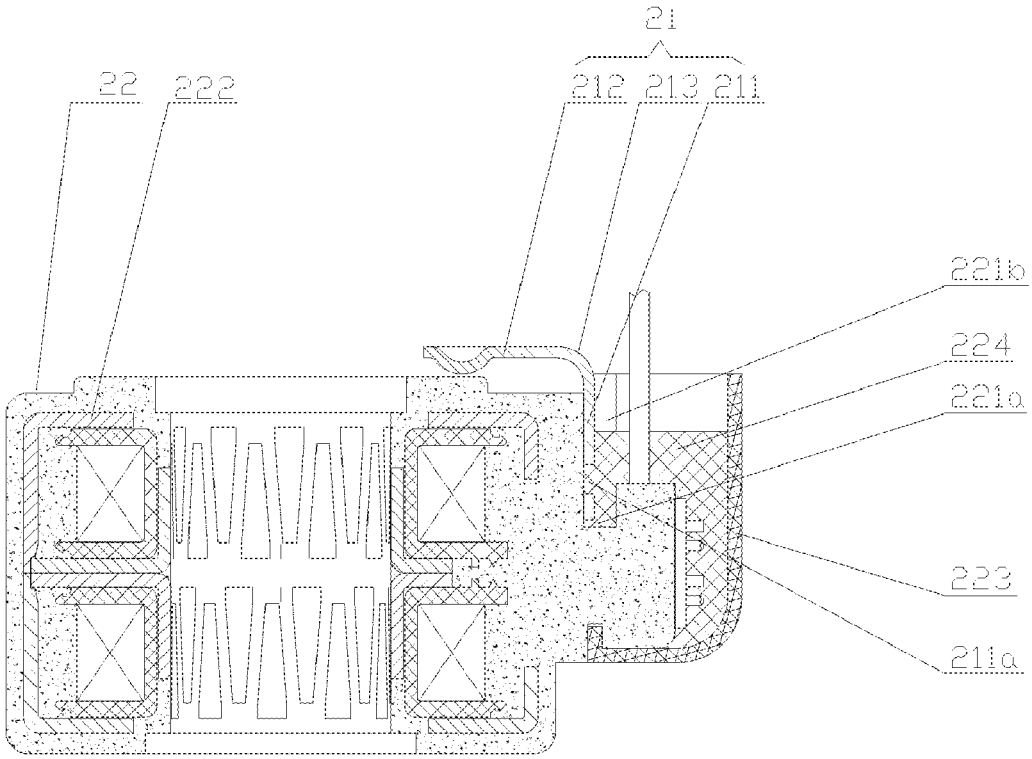
FIG. 2 is a structural schematic view of the electromagnetic coil device in an embodiment of the present invention.

Referring to FIG. 2, a structural schematic view of the electromagnetic coil device in an embodiment of the present invention is shown.

In a first embodiment, the electromagnetic coil device according to the present invention includes a coil body 22, which is provided with a connection terminal portion 221 projecting from the circumferential surface thereof. The electromagnetic coil device further includes a buckle 21, which has a positioning flat plate portion 212 and a inserting flat plate portion 211 fixedly connected with the positioning flat plate portion 212. The inserting flat plate portion 211 is pottedly connected to the connection terminal portion 221 with potting material. The potting material may be resin material, which is originally fluid-like, then gradually solidified after being placed for a period of time. Therefore, the fixed connection between the inserting flat plate portion 211 and the connection terminal portion 221 is achieved.

Compared with the screw connection, the fixed connection between the buckle 21 and the coil body 22 with potting material significantly improves the reliability of the connection therebetween. Furthermore, this kind of fixed connection may reduce the use of screw and thus reduce the manufacturing cost.

Compared with welding, the fixed connection between the buckle 21 and the coil body 22 with potting material may prevent a stator case 222 from electrochemical corrosion caused by dissimilar metal welding between the buckle 21 and the stator case 222 of the coil body 22. Therefore, the life span of the electromagnetic coil is prolonged.

As can be known from the above, the electromagnetic coil device according to the present invention can, on the one hand, reduce the manufacturing cost and improve the reliability of the connection between the coil body 22 and the buckle 21, and on the other hand, prevent the coil body 22 from being damaged by welding and thus improve the life span thereof.

Figure 6:
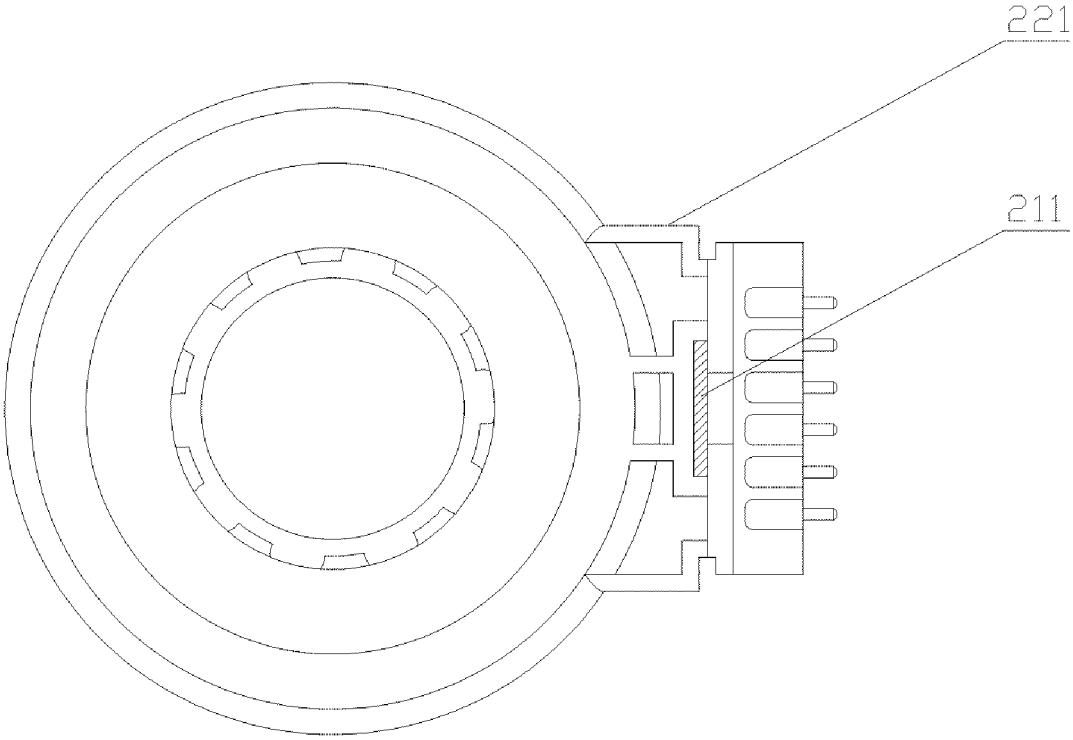
FIG. 6 is a schematic view of the assembly of an inserting flat plate portion of the buckle and a positioning groove of the electromagnetic coil device in an embodiment of the present invention.

Referring to FIGS. 2 and 6, FIG. 6 is a schematic view of the assembly of an inserting flat plate portion of the buckle and a positioning groove of the electromagnetic coil device in an embodiment of the present invention.

A second embodiment of the present invention is a further variant improved on the basis of the first embodiment described above.

In the second embodiment, as shown in FIG. 6, the connection terminal portion 221 of the electromagnetic coil device is further provided with a positioning groove 221*a*, within which the inserting flat plate portion 211 is pottedly connected with potting material.

Before potting, the inserting flat plate portion 211 of the buckle 21 is placed and fixed in the positioning groove 221*a*. Potting material is then poured into the positioning groove 221*a*, and surrounds the inserting flat plate portion 211 due to side walls of the positioning groove 221*a*. The inserting flat plate portion 211 is pottedly fixed in the positioning groove 221*a* after solidifying of the potting material. Such a way of pottedly fixing the inserting flat plate portion 211 in the positioning groove 221*a* is simple and convenient, easy to operate, and allows for a more reliable fixed connection between the inserting flat plate portion 211 and the connection terminal portion 221.

Figure 5:
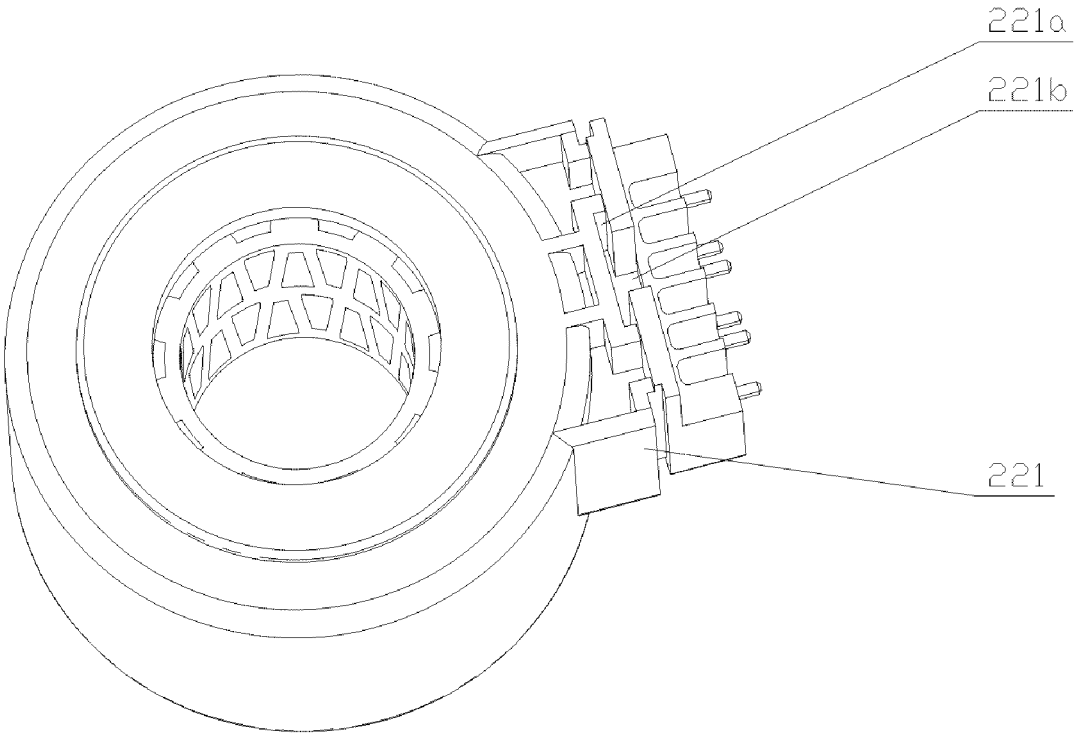
FIG. 5 is a structural schematic view of the coil body of the electromagnetic coil device in an embodiment of the present invention.

Referring to FIGS. 2 and 5, FIG. 5 is a structural schematic view of the coil body of the electromagnetic coil device in an embodiment of the present invention.

As shown in FIG. 2, the electromagnetic coil device further includes a terminal cover 223 surrounding the connection terminal portion 221. A potting chamber 224 is formed between the terminal cover 223 and the connection terminal portion 221 and the potting chamber 224 is communicated with the positioning groove 221*a* via a communicating passage 221 *b*.

In a third embodiment, the communicating passage 221*b* may be embodied as a communicating hole. The potting chamber 224 is an open chamber with an opening. The potting material is poured from the opening of the potting chamber 224 and flows into the potting chamber 224, and then flows into the positioning groove 221*a* through the communicating hole. On the one hand, the inserting flat plate portion 211 is pottedly fixed in the positioning groove 221*a* with the potting material so as to be fixedly connected to the connection terminal portion 221. On the other hand, due to blocking of the terminal cover 223, the potting material encapsulates the connection terminals and wires which have been connected together, which is safe, reliable and easy to operate.

In a fourth embodiment, the communicating passage 221*b* may be embodied as a communicating slot. The communicating slot has the same technical effect as that of the communicating hole in the third embodiment, except that potting material may be poured directly through the communicating slot so as to flow into the positioning groove 221*a* and the potting chamber 224 respectively. The communicating slot allows potting material to flow more quickly and conveniently between the positioning groove 221*a* and the potting chamber 224, so as to further facilitate the potting fixation of the inserting flat plate portion 211 in the positioning groove 221*a* with potting material.

Figure 3:
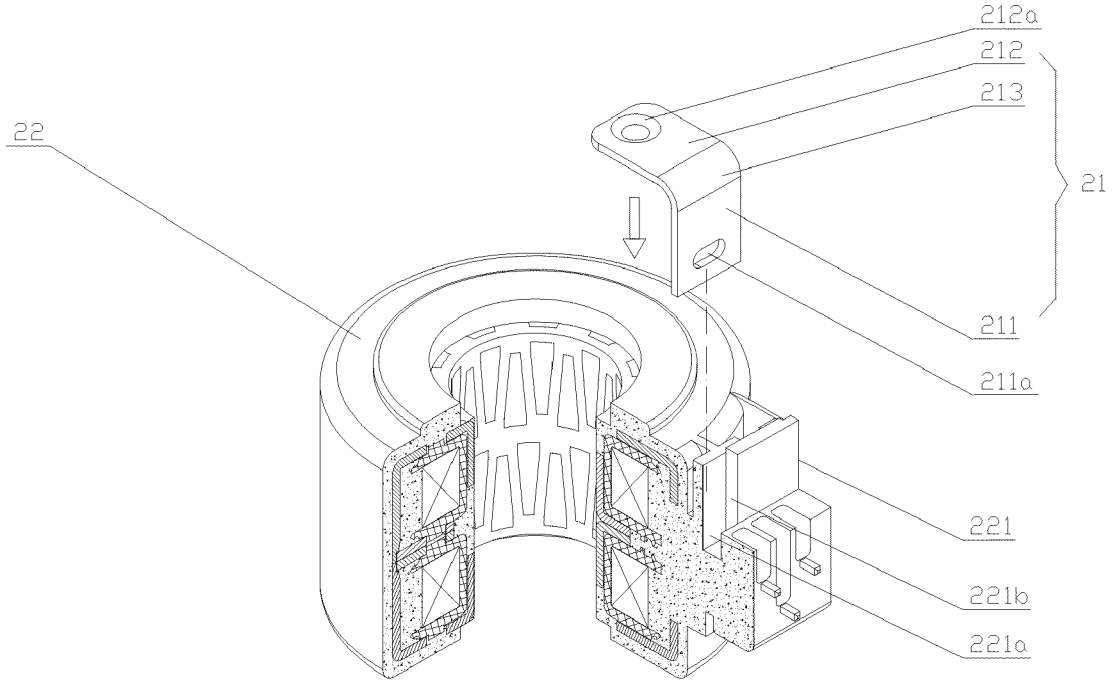
FIG. 3 is a structural schematic view of the electromagnetic coil device in an embodiment of the present invention before the buckle and the coil body is pottedly connected.

Referring to FIGS. 2 and 3, FIG. 3 is a structural schematic view of the electromagnetic coil device in an embodiment of the present invention before the buckle and the coil body is pottedly connected.

A fifth embodiment of the present invention is a further variant improved on the basis of the second embodiment described above.

In the fifth embodiment, the inserting flat plate portion 211 further has at least one positioning hole 211*a* passing therethrough. The positioning hole 211*a* is covered by the potting material. As shown in FIG. 3, the number of the positioning hole 211*a* is one. Certainly, the number may be more.

After potting material entering into the positioning groove 221*a*, a portion of potting material enters into the positioning hole 211*a*. After a period of time, the potting material is solidified. In particular, the potting material in the positioning hole 211*a* is solidified. The solidified potting material in the positioning hole 211*a*, on the one hand, serves as a block such that it is more difficult for the inserting flat plate portion 211 to slide out of the positioning groove 221*a*, and on the other hand, increases the contacting area between the potting material and the inserting flat plate portion 211 such that the inserting flat plate portion 211 receives larger fixing force from the potting material.

Figure 4:
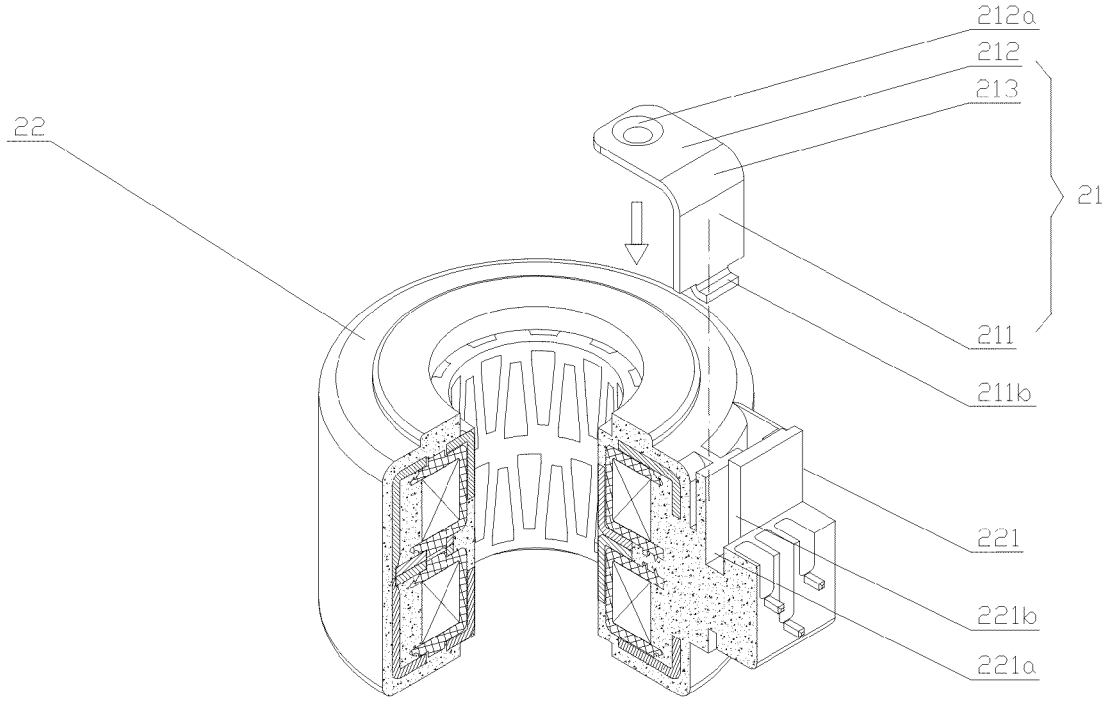
FIG. 4 is a structural schematic view of the electromagnetic coil device in another embodiment of the present invention before the buckle and the coil body is pottedly connected.

Referring to FIG. 4, FIG. 4 is a structural schematic view of the electromagnetic coil device in another embodiment of the present invention before the buckle and the coil body is pottedly connected.

A sixth embodiment of the present invention is a further variant improved on the basis of the second embodiment described above.

In the sixth embodiment, a positioning bending portion 211*b* is further provided at an end of the inserting flat plate portion 211 and is covered by the potting material. The positioning bending portion 211*b* has substantially the same technical effect as that of the above described positioning hole 211*a* in the fifth embodiment, that is, on the one hand, serving as a block such that it is more difficult for the inserting flat plate portion 211 to slide out of the positioning groove 221*a*, and on the other hand, increasing the contacting area between the potting material and the inserting flat plate portion 211 such that the inserting flat plate portion 211 receives larger fixing force from the potting material.

Referring to FIGS. 3 and 4, a further improvement can be made on the basis of the first embodiment described above. The buckle 21 further includes an arc-shaped connecting portion 213, through which a positioning flat plate portion 212 is fixedly connected to the inserting flat plate portion 211. The arc-shaped connecting portion 213 enables the connection between the positioning flat plate portion 212 and the inserting flat plate portion 211 to become firm, thereby providing higher safety and reliability.

Referring to FIGS. 3 and 4, a further improvement can be made on the basis of any one of the embodiments described above. The positioning flat plate portion 212 further includes a positioning projecting portion 212*a* projecting toward the coil body 22. The positioning projecting portion 212*a* cooperates with a groove in the fixing frame of the valve body device, so as to achieve a fixed connection between the electromagnetic coil device and the valve body device.

Referring to FIGS. 2 to 6, a further improvement can be made on the basis of any one of the embodiments described above. The connection terminal portion 221 can be formed by way of injection molding. When stator parts of the electromagnetic coil device are injection molded and encapsulated, the connection terminal portion 221 is injection molded at the circumferential surface of the stator parts. This is simple, convenient, easy to operate, and has a low cost in use.

The electromagnetic coil device according to the present invention is described in detail above. Herein, principles and embodiments of the present invention are illustrated by way of specific examples. The above illustration of the examples is only intended to help understand the methods and the spirit of the present invention. It should be noted that for persons skilled in the art, many improvements and modifications may also be made to the present invention without departing from the principle of the present invention. The improvements and modifications also fall into the protection scope defined by the claims of the present invention.

What is claimed is:

1. An electromagnetic coil device comprising a coil body having a connection terminal portion projecting from a circumferential surface of the coil body, a buckle having a positioning flat plate portion and an inserting flat plate portion fixedly connected to the positioning flat plate portion, wherein the inserting flat plate portion is pottedly connected to the connection terminal portion with potting material.

2. The electromagnetic coil device according to claim 1, wherein, the connection terminal portion further comprises a positioning groove, within which the inserting flat plate portion is pottedly connected with the potting material.

3. The electromagnetic coil device according to claim 2, further comprising a terminal cover surrounding the connection terminal portion, wherein a potting chamber is formed between the terminal cover and the connection terminal portion; and the potting chamber is communicated with the positioning groove via a communicating passage.

4. The electromagnetic coil device according to claim 3, wherein, the communicating passage is a communicating hole.

5. The electromagnetic coil device according to claim 3, wherein, the communicating passage is a communicating slot.

6. The electromagnetic coil device according to claim 2, wherein, the inserting flat plate portion further comprises at least one positioning hole passing therethrough, and the positioning hole is covered by the potting material.

7. The electromagnetic coil device according to claim 2, wherein, a positioning bending portion is provided at an end of the inserting flat plate portion and is covered by the potting material.

8. The electromagnetic coil device according to claim 1, wherein, the buckle further comprises an arc-shaped connecting portion, through which the positioning flat plate portion is fixedly connected to the inserting flat plate portion.

9. The electromagnetic coil device according to claim 1, wherein, the positioning flat plate portion further comprises a positioning projecting portion projecting toward the coil body.

10. The electromagnetic coil device according to claim 1, wherein, the connection terminal portion is formed by way of injection molding.

* * * * *